US005171145A

United States Patent [19]

Kusaka et al.

[11] Patent Number: 5,171,145

[45] Date of Patent: Dec. 15, 1992

[54] IMAGE FIXING APPARATUS FOR HEAT FIXING A TONER IMAGE THROUGH A FILM

[75] Inventors: Kensaku Kusaka, Kawasaki; Hiromitsu Hirabayashi, Yokohama; Tamotsu Okada, Kawasaki, all of Japan

[73] Assignee: Canon Kabushiki Kaisha, Tokyo, Japan

[21] Appl. No.: 735,709

[22] Filed: Jul. 25, 1991

Related U.S. Application Data

[63] Continuation of Ser. No. 435,247, Nov. 13, 1989, abandoned.

[30] Foreign Application Priority Data

Nov. 11, 1988 [JP] Japan ..... 63-285542
Nov. 11, 1988 [JP] Japan ..... 53-285543
Dec. 12, 1988 [JP] Japan ..... 63-161018[U]

[51] Int. Cl.[5] ..... G03G 15/20

[52] U.S. Cl. ..... 432/59; 355/286; 355/290; 219/216

[58] Field of Search ..... 355/282, 284, 286, 289, 355/290; 219/216, 388; 432/59, 60

[56] References Cited

U.S. PATENT DOCUMENTS 3,578,797 5/1971 Hodges ..... 263/3
3,811,828 5/1974 Ohta et al. ..... 432/227
3,948,215 4/1976 Namiki ..... 118/60
4,566,779 1/1986 Coli et al. ..... 355/3 R

FOREIGN PATENT DOCUMENTS 0295901 12/1988 European Pat. Off. .
51-29825 3/1976 Japan .
63-56662 3/1988 Japan .

*Primary Examiner*—Richard L. Moses
*Attorney, Agent, or Firm*—Fitzpatrick, Cella, Harper & Scinto

[57] ABSTRACT

An image fixing apparatus includes a heater; a film in contact with the heater, wherein heat from the heater is applied through the film to a toner image on an image supporting member; and wherein the film is in contact with an entire heat generating area of a heater.

40 Claims, 8 Drawing Sheets

IMAGE FIXING APPARATUS FOR HEAT FIXING A TONER IMAGE THROUGH A FILM

This application is a continuation of application Ser. No. 435,247 filed Nov. 13, 1989, now abandoned.

FIELD OF THE INVENTION AND RELATED ART

The present invention relates to an image fixing apparatus usable with an image forming apparatus such as a copying machine or an electrophotographic printer to fix a toner image on an image supporting member, and more particularly to an image fixing apparatus for heating and fusing the toner image for a film.

In a conventional image fixing apparatus wherein the toner image is fixed on a recording medium, the recording medium is passed through a nip formed between a heating roller maintained at a predetermined temperature and a pressing or back-up roller having an elastic layer and press-contacted to the heating roller, the recording medium supporting an unfixed toner image. However, the conventional image fixing system of this type requires that the heating roller is always maintained at an optimum temperature to prevent toner off-set, that is, toner transfer to the heating roller. Therefore, the thermal capacity of the heating roller and the heater has to be large, with the result of longer period for raising a temperature of the heating roller to a predetermined level, that the waiting period upon start of use of the apparatus is long and that the power consumption is large.

As a proposal for solving the problem of the toner off-set, U.S. Pat. No. 3,578,797 discloses that the toner is heated and fused through a web.

Also, Japanese Patent Publication No. 29825/1976 discloses that the toner is heated and fused by a heating roller through a belt.

In addition, U.S. Ser. No. 206767 which has been assigned to the assignee of this application discloses that the toner is heated and fused by a fixed heating member having a low thermal capacity through a heat resistive sheet, by which the warming period is significantly reduced.

In such fixing apparatus using a fixing film, particularly the apparatus using a low thermal capacity heater, local overheating can occur to fuse the heater if contact between the fixing film and the pressing member is not uniform. In order to assuredly fix the image on the recording medium, the heat generating length of the heater is longer than a maximum width of the recording medium used. In addition, the heat generating length is long enough to cover the recording medium obliquely fed.

Referring to FIG. 1, wherein the width of the fixing film 23 measured in the direction perpendicular to the conveyance direction of the recording medium is shorter than the length of the heat generating portion 28. In the area where the film 23 is contacted to the heat generating portion 47, the heat from the heat generating portion 28 is transmitted to the fixing film 23, whereas in the portion 40 where the film is not contacted, the heater itself is locally overheated. In the case that the temperature is controlled at the portion where the fixing film 23 and the pressing member 22 are contacted for the purpose of stabilizing the fixing property, the control conditions are different in the portion 40 where the fixing film is not contacted, and therefore, the situation is the same as when the control is not carried out.

In FIG. 2, the length of the pressing member is increased. In this case, however, the frictional coefficient between the pressing member 22 and the heater and the frictional coefficient between the pressing member 22 and the fixing film 23, are significantly different.

In the apparatus proposed in the U.S. Ser. No. 206767 mentioned hereinbefore wherein the heating member is stationary during the fixing operation, the significant difference between the frictional coefficients results in that the pressing member 22 and the fixing film 23 are not smoothly driven, which leads to slippage in the fixing station and the break of the film. In addition, as shown in FIG. 2, a step 41 is produced in the contact portion of the pressing member with the result of local overheating and damage of the heater described hereinbefore.

SUMMARY OF THE INVENTION

Accordingly, it is a principal object of the present invention to provide an fixing apparatus wherein the heater is not locally overheated.

It is another object of the present invention to provide an image fixing apparatus wherein the fixing film is smoothly driven.

It is a further object of the present invention to provide an fixing apparatus wherein the fixing film covers the entirety of the heat generating region of a heater.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
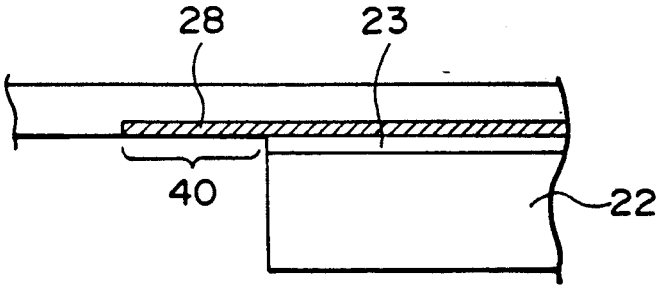
FIGS. 1 and 2 are sectional views illustrating problems with structures not using the present invention.
Figure 2:
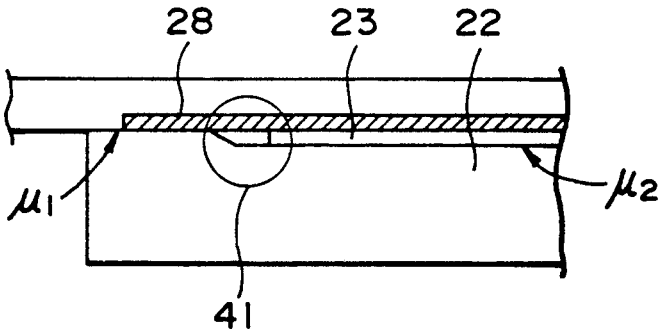

The preferred embodiments of the present invention will be described in conjunction with the accompanying drawings, wherein like reference numerals are assigned to the elements having the corresponding functions.

Figure 3:
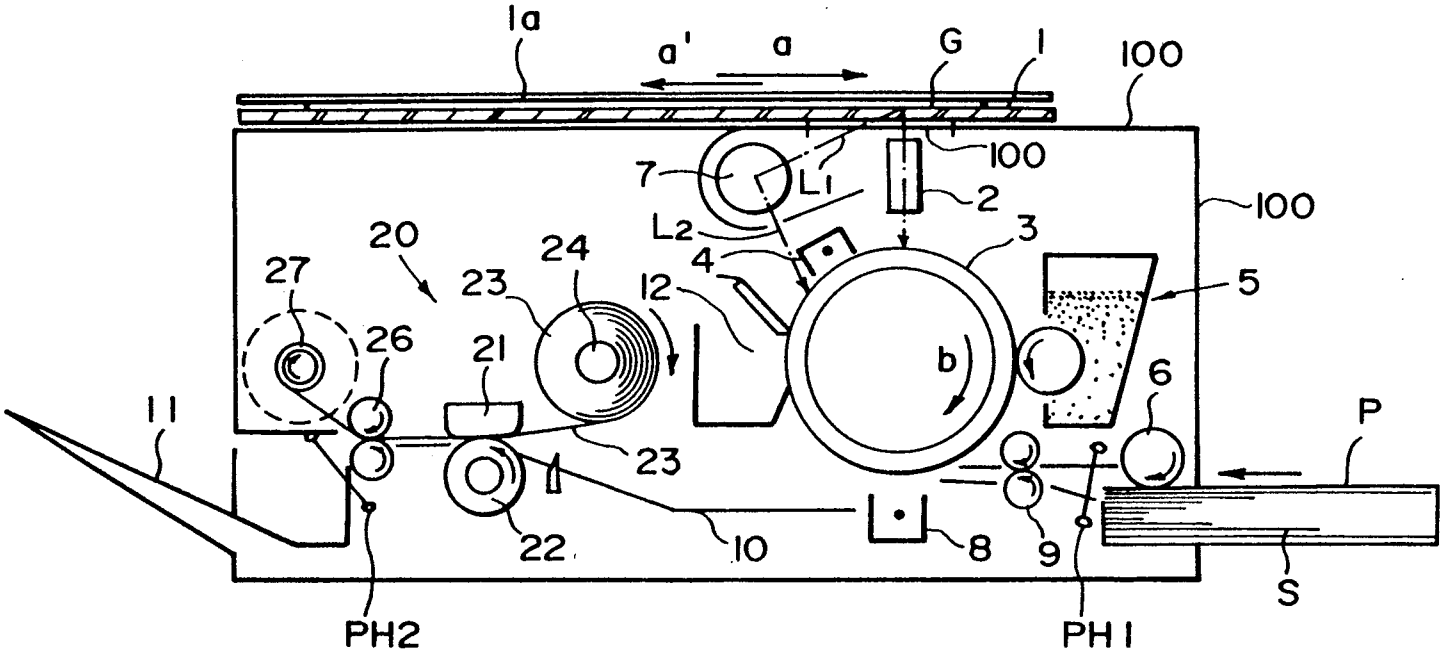
FIG. 3 is a sectional view of an image forming apparatus incorporating an image fixing apparatus according to an embodiment of the present invention.

FIG. 3 is a sectional view of an image forming apparatus of an electrophotographic type incorporating an image fixing apparatus according to an embodiment of the present invention.

The image forming apparatus comprises a casing 100, an original supporting platen 1 of a reciprocally movable type made of transparent material such as glass or the like disposed above the top plate 100*a* of the casing, wherein the platen 1 is reciprocated on the top plate 100*a* in the rightward direction (a) and in the leftward detection (a') in the Figure at the predetermined speeds.

Reference numeral G designates an original which is placed face down on the top of the original supporting platen 1 in aligned relation with an original reference index. The original is pressed by an original cover 1*a*. A slit opening 100*b* is formed in the top plate 100*a*, extending in a direction perpendicular to the reciprocal direction of the original supporting platen 1 (perpendicular to the sheet of the drawing), for the purpose of projecting an original image. The bottom image surface of the original G placed on the original supporting platen 1 is sequentially passes by the slit opening 100*b* during the rightward (a) stroke of the reciprocal movement of the original supporting platen 1, and it is sequentially illuminated by light L1 from a lamp 7 through the slit opening 100*b* and the transparent original supporting platen 1. The light reflected by the original is imaged on a surface of a photosensitive drum 3 through an array 2 of short focus small diameter imaging elements. The photosensitive drum 3 has a photosensitive layer such as a zinc oxide photosensitive layer or an organic photoconductor photosensitive layer. It has a central shaft 3*a* and is rotated in the clockwise direction b at a predetermined speed about the shaft. During the rotation, it is uniformly charged by a charger 4 to a positive or negative polarity. The charged surface is subjected to the image light (slit exposure), so that an electrostatic latent image is sequentially formed on the surface of the photosensitive drum 3 in accordance with the image of the original.

The electrostatic latent image thus formed is sequentially visualized by a developing device 5 with toner made of heat-softening or -fusing resin or the like into a visualized image. The visualized toner image is conveyed to an image transfer station having a transfer charger 8.

Recording mediums S in the form of transfer sheets P are accommodated in a cassette. The sheets P are fed out of the cassette one-by-one by rotation of a pickup roller 6. Then, the sheet is fed by a registration roller 9 at such a timed relation that when the leading portion of the toner image formed area on the drum 3 reaches the transfer discharger 8, the leading edge of the transfer sheet P reaches the position between the transfer discharger 8 and the photosensitive drum 3. In the transfer station, the toner image is sequentially transferred onto the transfer sheet from the photosensitive drum 3 by the transfer discharger 8.

The sheet having received the toner image in the transfer station is sequentially separated from the photosensitive drum 3 surface by an unshown separating means, and is guided by a conveying guide 10 to an image fixing apparatus 20 of this embodiment which will be described in detail hereinafter, where the unfixed image is fixed. Finally, it is discharged to an outside discharge tray 11 as an image product (copy).

On the other hand, the surface of the photosensitive drum 3 after the toner image has been transferred is subjected to a cleaning operation by a cleaning device 12, so that the contamination such as the residual toner, that is, the toner not having been transferred is removed. Then, the surface is exposed to whole exposure light L2, so that the electrical residual memory is removed to be prepared for the next image forming operation.

A reference PH1 is a sheet feed sensor (photosensor, for example) disposed in the sheet passage between the feeding roller 6 and the registration roller 9, and PH2 is a sheet discharge sensor (photosensor, for example) disposed next to the image fixing apparatus 20.

The description will be made as to the image fixing apparatus according to this embodiment.

Figure 4:
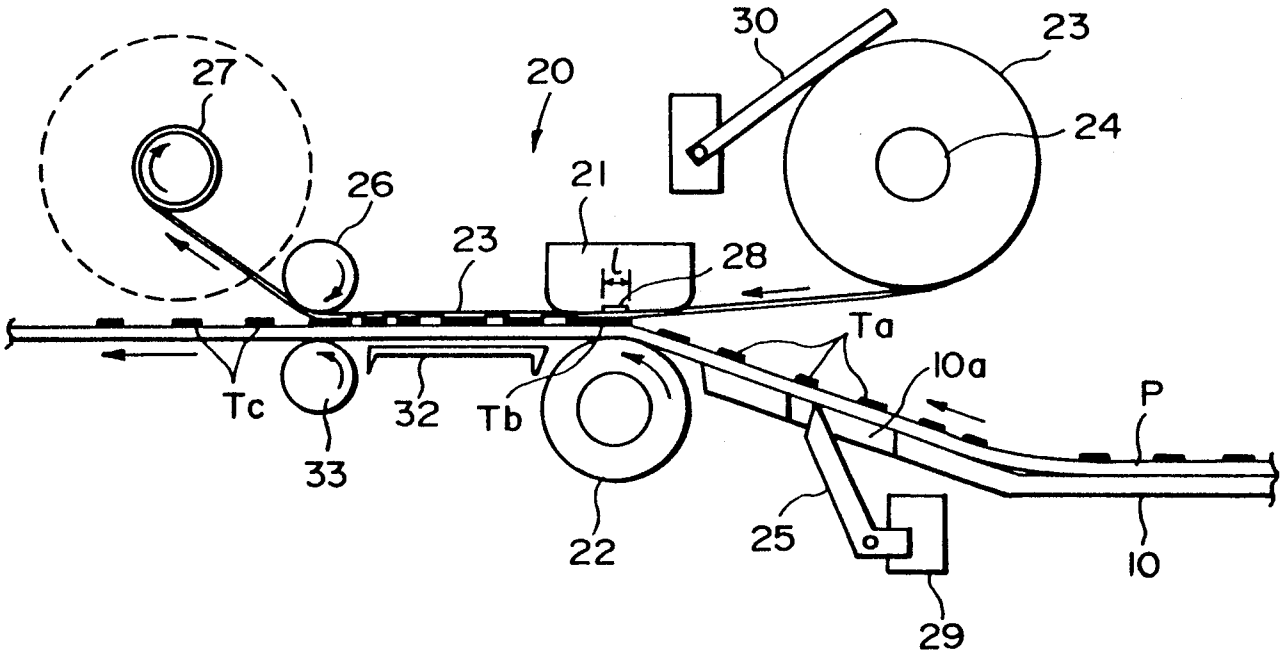
FIG. 4 is a sectional view of an image fixing apparatus according to an embodiment of the present invention.

FIG. 4 is a sectional view of the fixing apparatus 20. It comprises an image fixing film supply shaft 24 on which a desired length of the fixing film 23 is rolled, and the leading edge of the fixing film 23 is fixedly secured to a fixing film take-up shaft 27. The fixing film 23 in this embodiment is a long and thin plastic resin film made of PET (polyester) film having a thickness of 6 microns treated for heat resistivity, as a base material. The fixing apparatus further comprises a heating member 21 and a pressing roller 22 opposed to the top side and the bottom side of the fixing film, respectively, between the shafts 24 and 27. The heater 21 and the pressing roller 22 are normally urged to each other at desired pressure (total pressure of 4–6 kg in A4 width, for example) through a fixing film 23 by an unshown urging means. An upper separation roller 26 and a lower separation roller 33 are disposed opposed to the top side of the fixing film and the bottom side of the fixing film, respectively, next to the heater 21 and the pressing roller 22, and have large curvatures (small diameters). A guiding plate 32 is disposed between the pressing roller 22 and the bottom separation roller 33, and the guide plate 32 extends substantially horizontally in light contact with, or with a predetermined clearance from, the bottom surface of the fixing film stretched between the heater 21 and the upper separation roller 26. The pressing roller 22 includes a core member made of metal or the like and an elastic layer made of silicone rubber or the like thereon. The upper and lower separation rollers 26 and 33 are idler rollers freely rotatable.

The take-up shaft 27 is driven in the clockwise detection as indicated by an arrow by an unshown driving system, by which the fixing film 23 travels from the supply shaft 24 side to the take-up shaft 27 side at the same speed as and in the same direction as the sheet P conveyed from the image forming station (transfer station 8) through the guide 10 to the fixing apparatus 20. The pressing roller 22 is driven by an driving system in the counterclockwise direction as indicated by an arrow substantially at the same peripheral speed as the conveyance speed of the sheet P.

Designated by a reference numeral 30 is a sensor arm for sensing a removing amount of the fixing film, the sensor arm being contacted to an outer surface of the rolled fixing film 23 on the supply shaft 24. The remaining amount is detected on the basis of the diameter decrease of the roll of the film on the supply shaft due to the travel of the fixing film to the take-up shaft 27 by the execution of the image fixing process. When the film approaches the end, an alarming display or sound is produced to promote the operator to exchange the fixing film.

The heater 21 is made of a heat-resistive and electrically insulative material such as alumina or a material containing it, as a base material, and a heat generating layer 28 in the form of a line or stripe made of $Ta_2N$ or the like on the bottom surface of the base material, and a surface layer of $Ta_2O_5$ as a protection layer against sliding movement. The bottom surface of the heater 21 is smooth, and the front and rear edge portion are rounded to permit smooth sliding movement of the fixing film 23.

The heat generating layer 28 of the heater has a small thermal capacity and is pulsewisely energized. At each of the pulsewise energizations, it is instantaneously heated up to approximately 300° C.

A sheet detecting sensor 29 and a sheet detecting lever 25 are disposed adjacent to the fixing apparatus 20 and at a bottom side of the transfer material conveying guide 10 extending from the toner image transfer station 8 to the fixing apparatus 20. A free end of the lever 25 is projected upwardly through an opening 10*a* of the guide 10. In this state, the sensor 29 is in the off-state. The transfer sheet P is conveyed from the transfer station 8 to the fixing apparatus 20 along the top surface of the guide 10, and the leading edge of the sheet P kicks the lever 25, by which the lever 25 lowers into the opening 10*a*. The rotation of the lever 25 by the lowering actuates the sensor 29, so that the arrival of the sheet P at the sensor position is informed to an unshown control circuit. The lever 25 is kept contacted and pressed by the backside of the sheet P until the sheet P completely passes by the lever position, and therefore, it is maintained at the lowered position, thus maintaining the on-state of the sensor 29. When the trailing edge of the sheet P passes by the lever 25 position to be disengaged from the lever 25, the lever 25 becomes free to be projected again through the opening 10*a*. By this returning rotation, the sensor 29 is rendered off, and the passage of the sheet P at the position of the sensor is informed to the control circuit.

Next, the operation of the fixing apparatus according to this embodiment will be described. An original G is placed on the original supporting platen 1, and the operator sets the number of image formations, the size of the sheet P used and the magnifications or the like, and thereafter, the operator depresses the image formation start key, upon which, the pick-up roller 6 feeds the sheet P from the cassette S, and the fed sheet is detected by a sensor PH1. Also, the image forming operation is started to the photosensitive drum 3 surface.

In the image fixing apparatus 20, the driving system therefor starts to rotate the take-up shaft 27 and the pressing roller 22 to feed the fixing film 23 from the supply shaft 24 side to the take-up shaft 27 side at the same speed as the conveying speed of the sheet P, when a predetermined timer period elapses from the sheet detection by the sensor PH1, that is, when the time period elapses which is required for the sheet P fed out of the cassette S to passes through the registration roller couple 9, image transfer station 8 and the guide 10 until its leading edge reaches the neighborhood of the nip between the heating member 21 and the pressing roller 22. The heat generating layer 28 of the heating member 21 is energized in timed relation with the detection of the leading and trailing edges of the sheet P by the sensor 29 and the lever 25. Alternatively, the energization of the heat generating layer 28 may be controlled using the sheet detection by the sheet feed sensor of the image forming apparatus.

The top surface of the sheet carrying the unfixed toner image Ta introduced into the image fixing apparatus 20 is brought into close contact with the bottom surface of the fixing film 23 which is traveling at the same speed, and they are together passed through the nip between the heating member 21 and the pressing roller 22 without deviation or crease produced.

During the passage through the nip, the unfixed toner image on the recording medium surface is heated, softened and/or fused by the heater through the fixing film, and particularly, the temperature of the surface portion of the toner image becomes significantly higher than the toner fusing point so that it is completely softened or fused. During this, the heater, the fixing film, the toner image and the recording medium are properly pressed and contacted by the nip between the heating member and the pressing member, so that the heat transfer occurs very effectively, so that the toner is completely softened and fused by the short period heating. On the other hand, the temperature rise of the recording material itself is practically very small, so that the thermal energy is not wasted. Namely, the recording medium itself is not practically heated, and only the toner can be effectively heated, softened and fused, so that the toner image can be heated and fixed with low power consumption.

Here, the state of the toner referred to in this Specification will be described. The toner fusing point used here means the minimum temperature required for fixing the toner and covers the case where the viscosity thereof decreases to such an extent as can be said to be fused, at the minimum fixable temperature and the case where the viscosity decreases to such an extent as can be said to be softened, at the minimum fixable temperature. Therefore, even when it is said that the toner is fused for convenience, it actually may mean the viscosity decrease to such an extent that it is actually softened. Similarly, when it is said that the toner is cooled and solidified for convenience, it actually may not be solidified depending on the materials of the toner, but can be said that the viscosity is sufficiently increased.

In the heating process in this embodiment, the linear heat generating layer 28 having a low thermal capacity formed integrally on the heater 21 is pulsewisely energized. By this, the toner image Ta on the sheet P being conveyed at the conveying speed Vp (mm/sec) is introduced into the effective width l of the linear heating portion determined by the width of the heat generating surface 28 of the heater 21 together with the fixing film 23 moving at the speed corresponding to the sheet P conveying speed, and is heated into a softened or fused image Tb.

The portion of the sheet having passed through the nip between the heater 21 and the pressing roller 22 is continued to be contacted with the fixing film stretched and traveled between the heating member 21 and the upper separation roller 26, until the portion reaches the position of the separation rollers 26 and 33. The guiding plate 32 supports the backside of the sheet P to maintain the contact with the fixing film.

In place of the guiding plate 32, a rotatable guiding belt may be stretched around the pressing roller 22 and the lower separation roller 33 to support the backside of the sheet P to maintain the close-contact with the fixing film 23.

This conveying period is used as a cooling step to radiate the heat of the toner softened and fused during the heating period, so that the toner is cooled and fixed. By the cooling and solidification, the coagulation force of the toner becomes significantly large so as to behave as a mass. In addition, the adherence and bonding to the recording medium are increased, and, on the other hand, adherence and bonding to the fixing film decreases significantly. Since the heated, softened or fused toner during the heating process is pressed to the recording medium by the pressing member, and therefore, at least a part of the toner image is soaked into the surface layer of the recording medium, and the soaked and solidified portion provides an anchoring effect to increase the adherence and fixing force of the cooled and solidified toner to the recording medium.

The sheet reaches the position of the upper separation roller couple 26, the fixing film 23 is deflected away from the surface of the sheet P along the outer peripheral surface of the upper separation roller 26 having a large curvature, by which the fixing film 23 and the sheet P are separated, and the sheet is discharged onto the discharge tray 11. By the time of the separation, the toner is sufficiently cooled and solidified so that the toner is sufficiently fixed on the sheet P, on the other hand, the adherence of the toner to the fixing film 23 is very small. Therefore, the separation between the fixing film 23 and the sheet P is effected easily without production of the toner offset to the fixing film 23.

The take-up drive of the fixing film 23 of the fixing apparatus 20 is stopped upon the trailing edge detected by the sheet discharge detecting sensor PH2 after the passage of the sheet P through the fixing apparatus 20.

In this embodiment, the fixing film 23 is driven to move from the supply shaft 24 side to the take-up shaft 27 side at the same speed as the sheet P conveyance speed, each time the sheet P is processed.

The control for the drive (forward drive) of the fixing film may be such that the drive starts upon elapse of a first timer period from the sheet detection by the sheet detection sensor PH1, and that the drive is stopped upon the elapse of the second timer period, wherein the fixing process is executed to the sheet P during the period from the start to the stop. In this case, the discharge sheet detection sensor PH2 is not used.

Alternatively, the drive control may be carried out using the sheet leading edge and trailing edge detection signals by the sensor 29 and the lever 25.

In this embodiment, the linear heat generation layer 28 of the heater 21 is instantaneously heated by energization up to a sufficiently high temperature beyond the toner fusing point (or the fixable temperature), and therefore, the preliminary heating of the heating member is not required, so that the heat transfer to the pressing roller 22 when the fixing operation is not carried out is small. During the fixing operation, the fixing film, the toner image and the sheet are between the heater 21 and the pressing roller 22, and the temperature gradient is very steep because of the short heat generating period, and therefore, the pressing roller 22 is not easily heated so that the temperature of the pressing roller 22 is maintained below the toner fusing point even when practically required continuous image formation is performed.

In the apparatus of this embodiment having the structure described above, the toner image made of heat-fusible toner on the sheet P is first heated and fused by the heater 21 through the fixing film 23, and particularly the surface portion thereof is completely softened or fused. At this time, the heater, the fixing film, the toner image and the sheet are pressed by the pressing roller 22, so that the heat is efficiently transferred. Therefore, the heating of the sheet P is minimized with the toner image efficiently heated and fused.

By limiting the energization period for the heat generation, the energy can be saved.

The size of the heater may be small, so that the thermal capacity thereof may be small, and therefore, it is not necessary to raise the temperature of the heater. In addition, the power consumption when the image is not formed can be reduced, and the temperature rise in the apparatus can be prevented.

In this embodiment, the temperature of the pressing roller 22 is maintained below the toner fusing point as described above, and therefore, the heat radiation of the toner image can be promoted in the cooling step following the toner image heating step. Therefore, the time period required for the cooling may be small, and the size of the apparatus can be made small.

The description will be made as to the dimensions of the heater 21, the pressing roller 22, the fixing film 23 and the recording medium P in the direction perpendicular to the recording medium conveying direction.

Figure 5A:
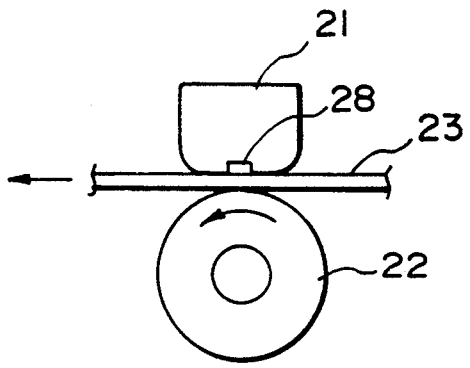
FIGS. 5A and 5B are partial enlarged view and a top plan view of the image fixing apparatus shown in FIG. 4.
Figure 5B:
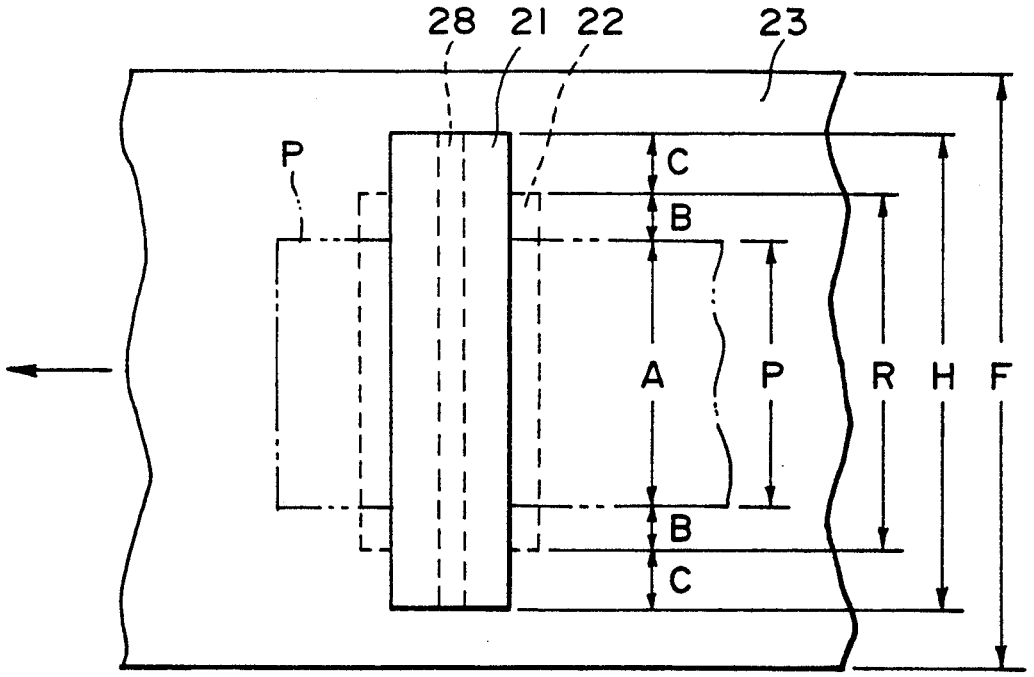

FIGS. 5A and 5B show the dimensional relationship among the heater 21, the pressing roller 22, the fixing film 23 and the transfer sheet P (recording medium). Those dimensions satisfy:

$$P \leqq R \leqq H \leqq F$$

where H is an entire length of a heat generating layer or surface in the form of a line provided in the heater 21, measured in the lateral direction of the fixing film; R is an entire length of the pressing roller 22 opposed to the heater 21 with the fixing film 23 therebetween; F is a width of the fixing film 23; and P is a width of the transfer sheet P (the dimension measured in the direction perpendicular to the conveyance direction.

In consideration of the slight inclination of the transfer sheet or unavoidable mounting error of the parts, the preferable relationships are:

$$P < R < H < F$$

In this embodiment, the conditions $P < R < H < F$ are satisfied. More particularly, the heat generating surface 28 of the heater 21 and the fixing film 23 satisfy $H < F$, by which the fixing film 23 is contacted over the entire length of the heating surface 28.

Here, the case of continuing the fixing operation for plural number of sheets. In the region P, the quantity of heat Q produced by the heat generating surface 28 is transferred mainly to the transfer material, so that in the heat generating region (A region) corresponding to the region P, no overheating occurs. In the region within R but outside P (B and B regions), the heat quantity Q transfers mainly to the fixing film 23 and the pressing roller 22, and therefore, the heat generating surface corresponding to this region is not overheated. In the region within H but outside R (C and C regions) the heat quantity Q mainly moves to the fixing film 23, and therefore, the region of the heat generating surface corresponding to this region is not overheated. Therefore, even if the thermal capacity of the heat generating surface 28 of the heater 21 is small, it is prevented from overheating over the entire region H. Therefore, the heat generating surface is protected from thermal damage due to the overheating, thus increasing the durability of the heater 21.

Figure 6A:
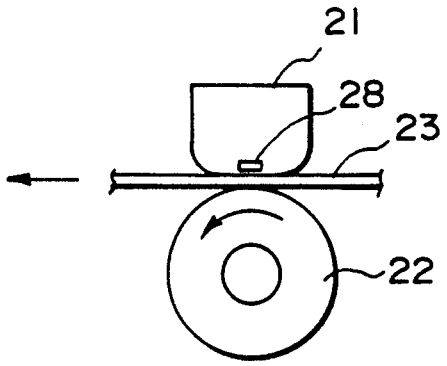
FIGS. 6A and 6B are partial enlarged view and a top plan view of a comparison example.
Figure 6B:
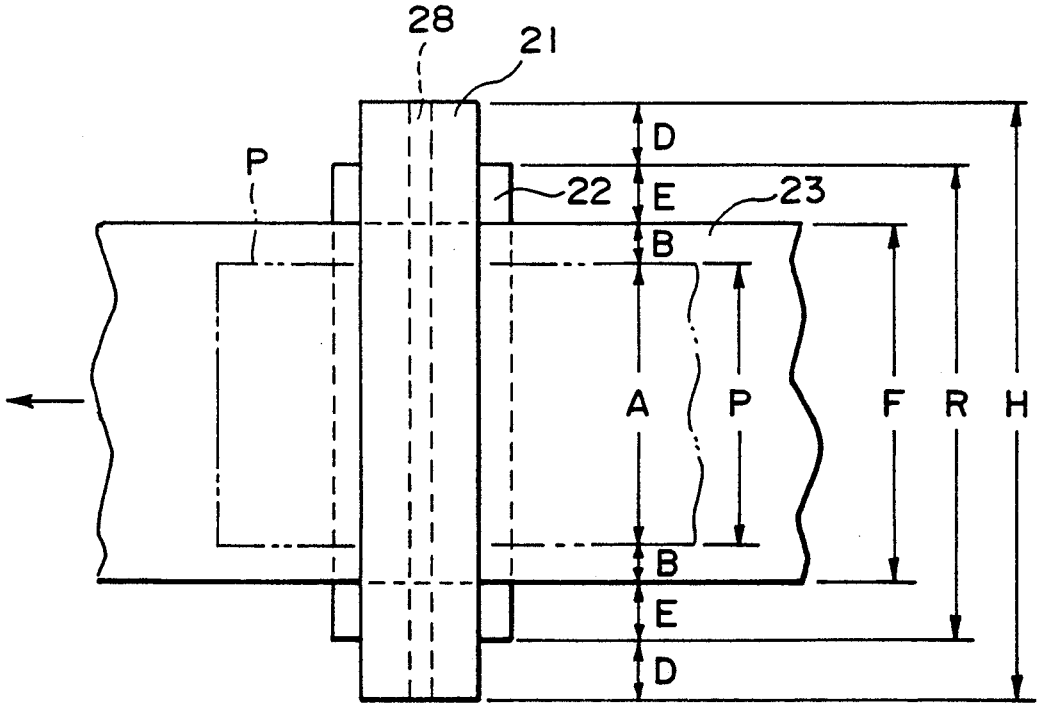

FIG. 6 shows a comparison example wherein the overheating tends to occur as in the example shown in FIG. 1. In this structure, the dimensional relationships are $P<F<R<H$. The heat generating surface 28 of the heater 21 and the fixing film 23 satisfy $F<H$, and the therefore, the region H of the heat generating surface 28 contain adjacent the opposite ends, the portions not contacted to the fixing film 23.

When the fixing process is continued, the fixing film or the pressing roller functioning to positively absorb the heat does not exist in the region within H but outside R (regions D and D) of the heat generating surface 28 of the heater 21. Therefore, the heat transfer occurs only by the radiation from the heat radiating surface into the ambience with low heat transfer efficiency. Therefore, this region of the low thermal capacity heat generating surface 28 is easily overheated with the result of easy occurrence of thermal damage. In the region within R but outside F (regions E and E), the heater 21 and the pressing roller 22 are directly contacted and pressed to each other, and therefore, the surface of the pressing roller 22 rotationally driven is in the sliding contact with the fixed heater 21 surface with the result of increased required torque of the pressing roller 22. Therefore, the portion of the heat generating surface 28 corresponding to the regions E and E is quickly worn by the direct sliding contact with the pressing roller 22.

In the embodiment of the present invention shown in FIG. 5, the pressing roller 22 and the fixing film 23 satisfy $R<F$, so that the fixing film 23 is contacted to the entire length of the pressing roller 22.

Thus, the pressing roller 22 is not directly contacted to the heater 21 but is urged through the fixing film 23. Therefore, the sliding contact, wearing and damage can be prevented in the portions of the heat generating surface 28 corresponding to the areas E and E where they are directly contacted (FIG. 6). By this, the durability of the heater is increased, and in addition, the rotational driving torque of the pressing roller 22 can be reduced because of the absence of the frictional resistance resulting from the direct contact portions E and E. This permits simplification of the driving system of the fixing apparatus.

Figure 7A:
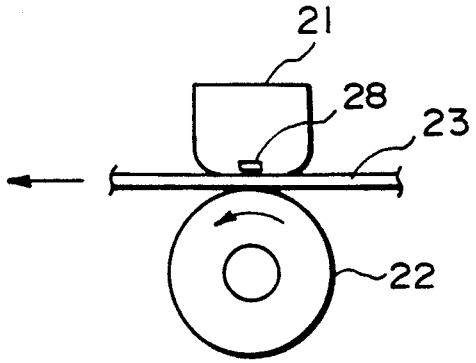
FIGS. 7A and 7B are partial enlarged view and a top plan view of an image fixing apparatus according to another embodiment of the present invention.
Figure 7B:
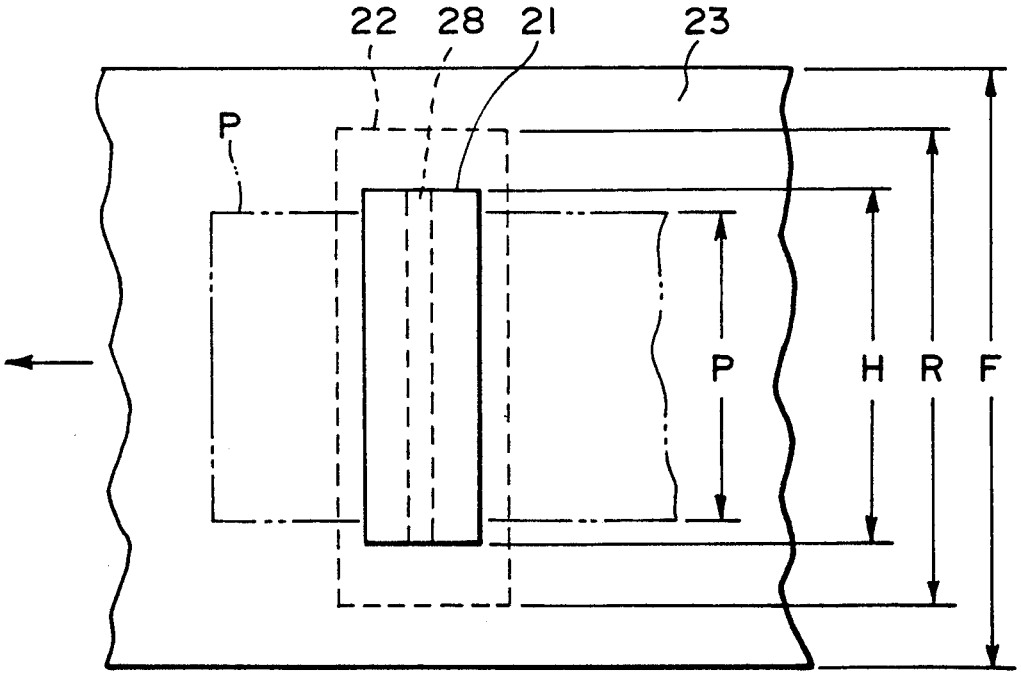

Referring to FIG. 7, another embodiment of the present invention will be described. In this embodiment, the following is satisfied:

$$P \leqq H \leqq R \leqq F$$

More particularly, the following is satisfied in this example, $P<H<R<F$, therefore, $H<F$ is satisfied also in this embodiment, so that the entire length H of the heat generating surface 28 of the heater 21 is press-contacted to the fixing film 23 by the pressing roller 22. Therefore, the heat transfer efficiency is good at any points of the entire heat generating surface region H. Thus, any portion of the heat generating surface is not overheated, so that the durability of the heater is enhanced.

In this FIG. 7 example, $R<F$ is also satisfied, and therefore, the heater (heat generating surface 21) 28 is not directly rubbed by the pressing roller 22, and therefore, the drive of the fixing film can be effected smoothly with low torque. From the standpoint of the smooth drive of the fixing film, the conditions $P<R<F<H$ are satisfactory. However, if $F<H$, the problem of the overheating described above arises, and therefore, the embodiments shown in FIGS. 5 and 7 are preferable.

Figure 8:
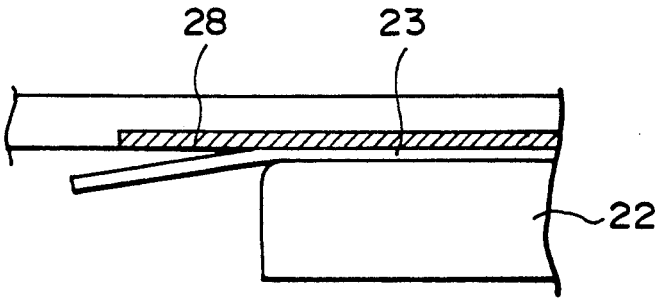
FIG. 8 is a partial enlarged view for illustrating the present invention.

In FIG. 5 embodiment, $R<H$. In this case, if the tension of the fixing film is not large enough, the contact between the fixing film 23 and the heat generating surface 28 is not enough as shown in FIG. 8 with the possible result of decreased heat transfer through the fixing film 23. Therefore, $H<R$ is preferable as shown in FIG. 7.

The fixing film 23 may be of the type wherein it is gradually fed from the supply shaft 24 side to the take-up shaft 27 side each time the fixing operations is performed, and when the entire length thereof is taken-up, a new fixing film 23 is set. In consideration of the practically no toner offset to the fixing film 23, the fixing film 23 may be rewound on the supply shaft 24 at proper times, or the take-up side and the supply side are exchanged with each other to repeatedly use the fixing film, if the thermal deformation or thermal deterioration of the film is not significant (rewinding and repeatedly using type). In a further alternative type, the fixing film 23 may be in the form of an endless belt.

In the first type, the fixing film 23 may be made of thin polyester resin (low cost) treated for heat resistance, and the thickness thereof can be reduced without regard to the durability, so that the power consumption can be reduced.

In the rewinding and repeatedly using type, the fixing film may be made of polyimide resin film having a thickness of 25 microns having heat resistivity and mechanical strength which is coated with a parting layer made of fluorine resin or the like having a high parting property, into a compound layer film. It is preferable that during the rewinding movement, the urging of the pressing roller 22 to the heater 21 is released.

When the fixing film is repeatedly used as in the rewinding and repeatedly using type or in the endless belt type, a felt pad may be contacted to the surface of the film, and the pad is impregnated with silicone oil or the like to clean the film surface and to provide the film surface with the parting property. When the fixing film has been treated with insulating fluorinated resin, electrostatic charge which can disturb the toner image is easily produced on the film. To obviate this problem, the film may be electrically discharged using a grounded discharging brush. Alternatively, the brush may be supplied with a bias voltage to charge the film within the range not disturbing the toner image. As a further alternative, the fluorinated resin may be added with conductive powder or fiber such as carbon black or the like to disturb the image disturbance by the electrostatic charge. The same means are applicable to the pressing roller for the purpose of electric discharge or for the purpose of providing it with the conductivity.

In addition, electrification preventing agent may be applied or added.

In any of the types, the fixing film 23 may be in the form of a cartridge detachably mountable at a predetermined position of the fixing apparatus, thus making the fixing film exchanging operation easier.

The structure of the heater 21 and the power supply control to the heat generating surface (layer) 28 are not limited to those described in the foregoing. For example, the heat generating surface 28 of the heater may be replaced with a thick film resistor, or an array of ceramic chips having PPC characteristics, and the energization control is not limited to the pulsewise energization, but may be always energized, if the heat generating portion supplied with electric power of the heater and the heating portion for heating the toner are integrally formed, and are fixedly supported.

Figure 9:
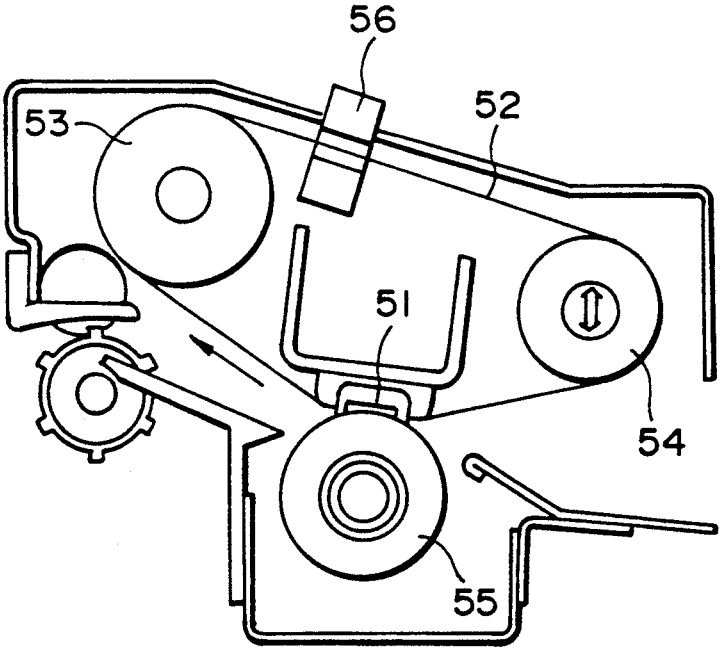
FIG. 9 is a sectional view of an image fixing apparatus according to a further embodiment of the present invention.

FIG. 9 shows an image fixing apparatus according to a further embodiment of the present invention, which comprises a low thermal capacity heater 51 fixedly supported on the fixing apparatus and a fixing film 52 movable in the direction indicated by an arrow in contact with the heater 51. The fixing film 52 is stretched between a driving roller 53 (conveying means) and a follower roller 54 and is driven by the driving roller 53. A pressing roller 55 has a rubber elastic layer made of silicone rubber or the like having good parting property and is urged to the heater 51 through the fixing film 52. The pressing roller is rotatable. A recording medium (not shown) having an unfixed toner image is introduced into a nip formed by the pressing roller 55, by which the image is fixed. At an end portion of the fixing film 52, there is disposed a detector portion 56 such as a photosensor to detect the position of the film. By driving means (not shown) operable in synchronism with the detection signal, an eccentric cam (not shown) is rotated to displace the follower roller 54 to control the position of the fixing film 52. More particularly, when the fixing film 52 starts to shift in one direction to such an extent that the fixing film 52 is detected by the detecting portion 56, the follower roller 54 is shifted to provide the film with the opposite lateral shifting force, by which the lateral shifting of the fixing film 52 is controlled.

When the opposite shifting is detected, the eccentric cam (not shown) is further rotated to shift the follower roller. By this shifting control mechanism, the ends of the fixing film 52 are maintained within a predetermined range.

Figure 10:
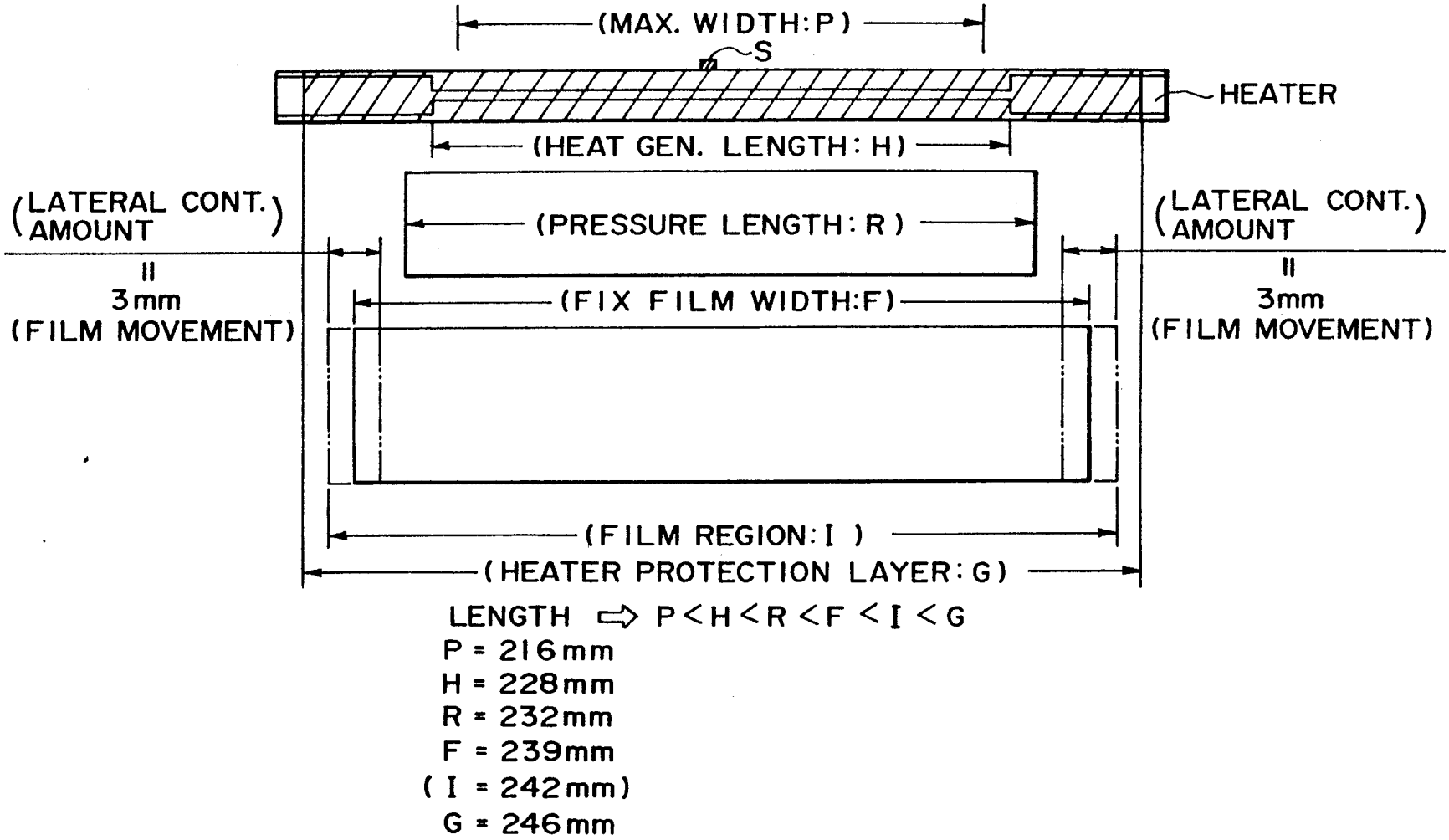
FIG. 10 shows relations among longitudinal dimensions in the embodiment shown in FIG. 9.

FIGS. 9 and 10 show dimensional relations, in the longitudinal direction (in a direction perpendicular to the movement direction of the recording medium in this embodiment), of various elements of the fixing apparatus. More particularly, [the fixing film length (239 mm)]>[pressing portion length (232 mm)]>[heat generating length (228 mm)]>[maximum sheet passage width (216 mm)], are satisfied.

In this longitudinal dimension relationships, the heat generating length relative to the maximum sheet passage width (216 mm) is selected so as to provide a margin of 12 mm in consideration of the lateral shift of the sheet, the oblique conveyance of the sheet and the temperature distribution of the heater. As regards the length of the pressing portion, it is selected with a margin of 4 mm relative to the heat generating portion in consideration of the thrust play of the pressing portion and the accuracy of the parts.

The fixing apparatus comprises the lateral shift control mechanism for the fixing film 52, and therefore, the fixing film length is determined so that it is larger than that of the pressing portion even when the film is shifted by the lateral shift control (±1.5 mm). More particularly, in order to provide the margin of 2 mm by which the film 52 is longer than the pressing portion, even when the fixing film 52 is laterally shifted by the lateral shift control (1.5 mm one side), the fixing film length=[pressing portion length (232 mm)]+[lateral shift control (3 mm at both sides)]+[margin (4 mm at both sides)].

That is, the fixing film is longer than the pressing portion by 7 mm.

In the heater 1, at the contact portion with the fixing film 52, a protection layer of glass is evaporated on the surface of the heater to prevent wearing of the film contacting surface.

The length of the protection layer is larger than the length of the fixing film. In consideration of the margins for the lateral shift control of the fixing film 52, that is, in consideration of the moving region of the fixing film 52, the protection layer length=[fixing film length (239 mm)]+[movement amount (3 mm at both sides)]+[margin (4 mm at both sides)].

That is, the length of the protection layer is 246 mm.

As described according to this embodiment, the fixing film is in the form of an endless film. Even if the endless film is laterally shifted, the heat generating portion of the heater is prevented from the local overheating and damage such as fusing, and the conveyance and drive of the pressing member and the fixing film can be stabilized.

As shown in FIG. 10, in order to control the heat generation of the heater, a thermister S for detecting the temperature of the heater is disposed within the maximum sheet passage width P, more particularly adjacent the middle of the width which is within the minimum sheet passage width. By doing so, the control conditions for the temperature control of the heat generating portion H is the same at any portion. In this embodiment, the sheet is positioned with its center registered with the center of the conveyance passage, and therefore, the longitudinal margins at the opposite sides are distributed uniformly. If the sheet is conveyed with registration at one side, the same margin setting is possible, but the margins at the opposite sides may be different as the case may be.

While the invention has been described with reference to the structures disclosed herein, it is not confined to the details set forth and this application is intended to cover such modifications or changes as may come within the purposes of the improvements or the scope of the following claims.

what is claimed is:

1. An image fixing apparatus for fixing a toner image on a recording material as it is conveyed through the fixing apparatus in a predetermined direction, comprising:

a heater extended in a direction perpendicular to the conveyance direction of the recording material, wherein said heater includes a linear heat generating layer extended in a direction perpendicular to the conveyance direction of the recording material; and a movable film in contact with said heater wherein heat from said heater is applied through said film to the toner image on the recording material, wherein said film has a width larger than a length of said heat generating layer.

2. An image fixing apparatus for fixing a toner image on a recording material as it is conveyed through the fixing apparatus in a predetermined direction, comprising:

a heater extended in a direction perpendicular to the conveyance direction the recording material; and a movable film in contact with said heater, wherein heat from said heater is applied through said film to the toner image on the recording material, wherein said film is in contact across a width of an entire heat generating area of said heater in a direction perpendicular to the conveyance direction of the recording material and wherein the heat generating area is longer, in a direction perpendicular to the conveyance direction of the recording material, than a width of a maximum usable size of the recording material.

3. An apparatus according to claims 1 or 2, wherein said heater is stationary during its image fixing operation, and said film slides on said heater.

4. An apparatus according to claims 1 or 2, wherein a side of said film contactable with the toner image is coated with a parting layer.

5. An apparatus according to claims 1 or 2, wherein said film is an endless film.

6. An image fixing apparatus for fixing a toner image on a recording material as it is conveyed through the fixing apparatus in a predetermined direction, comprising:

a heater extended in a length perpendicular to the conveyance direction of the recording material;

a film movable together with said recording material, wherein heat from said heater is applied to the toner image on the recording material through said film;

a pressing rotatable member for urging said film and the recording material to said heater;

said film having a width covering an entire length of said pressing rotatable member.

7. An apparatus according to claim 6, wherein said heater extends beyond longitudinal ends of said pressing rotatable member.

8. An apparatus according to claim 6, wherein said heater is stationary during its image fixing operation, and said film slides on said heater.

9. An apparatus according to claim 7, wherein said film has a width covering an entire area of said heater.

10. An apparatus according to claim 9, wherein said heater includes a linear heat generating layer extended in a direction perpendicular to the conveyance direction of said recording material, and wherein said film has a width larger than a length of said heat generating layer.

11. An apparatus according to claim 6, wherein a heat generating portion of said heater is longer, in a direction perpendicular to the conveyance direction of the recording, than a width of a maximum usable image supporting member.

12. An apparatus according to claim 6, wherein a side of said film contactable with the toner image is coated with a parting layer.

13. An apparatus according to claim 6, wherein said film is an endless film.

14. An image fixing apparatus, comprising:

a heater;

a film movable together with an image supporting member for supporting a toner image, wherein heat from said heater is applied through said film to the toner image on the image supporting member;

a pressing member for urging said film and the image supporting member to said heater;

wherein a pressing portion provided by said pressing member and said film have lengths, measured in a direction perpendicular to a movement direction of the image supporting member, which are larger than a length of a heat generating portion of said heater.

15. An apparatus according to claim 14, wherein said film is larger, in a direction perpendicular to a movement direction of the image supporting member, than a length of the heating portion.

16. An apparatus according to claim 14, wherein said heater is stationary during its image fixing operation, and said film slides on said heater.

17. An apparatus according to claim 14, wherein said heater has a linear heat generating layer extending in a direction crossing with the movement direction of the image supporting member, and the length of said heat generating portion is the length of the heat generating layer.

18. An apparatus according to claim 14, wherein said heat generating portion is longer, in a direction crossing with a conveyance direction of the image supporting member, than a width of a maximum usable size of said image supporting member.

19. An apparatus according to claim 14, wherein a side of said film contactable with the toner image is coated with a parting layer.

20. An apparatus according to claim 14, wherein said film is an endless film.

21. An apparatus according to claim 14, wherein said heater has a surface protection layer which is longer than said film.

22. An apparatus according to claim 14, wherein said protection layer is of glass.

23. An image fixing apparatus, comprising:

a heater;

an endless film contactable with said heater;

control means for controlling a lateral position of said endless film to maintain the lateral shift of the film within a predetermined amount;

wherein said endless film has a dimension larger than a dimension of a heat generating portion of said heater in a direction perpendicular to a movement direction of the image supporting member by an amount which is larger than the lateral shift.

24. An apparatus according to claim 23, wherein said heater is stationary during its image fixing operation, and said film slides on said heater.

25. An apparatus according to claim 23, wherein said heater includes a linear heat generating layer extending in a direction crossing with the movement direction of the image supporting member, and said heat generating portion corresponds to the heat generating layer.

26. An apparatus according to claim 23, wherein said heat generating portion is longer, in a direction crossing with a conveyance direction of the image supporting member, than a width of a maximum usable size of said image supporting member.

27. An apparatus according to claim 23, wherein said control means includes detecting means for detecting a position of said endless film, and displaces a rotatable member rotating together with said endless film in accordance with detection signal from said detecting means to control the position of said endless film.

28. An apparatus according to claim 27, further comprising a driving roller for driving said endless film and a follower roller rotating following said endless film, and the displaceable rotatable member is the follower roller.

29. An apparatus according to claim 23, wherein said heater has a surface protection layer having a length, measured in a direction perpendicular to the movement direction of the image supporting member, which covers the moving range of said endless film.

30. An apparatus according to claim 29, wherein said protection layer is of glass.

31. An image fixing apparatus, comprising:

a heater;

an endless film movable together with an image supporting member for supporting a toner image, wherein heat from said heater is applied through said endless film to the toner image on the image supporting member;

control means for controlling a lateral position of said endless film to maintain lateral shift of said film within a predetermined amount;

pressing member for pressing said film and the image supporting member to said heater;

wherein said endless film has a length, in a direction perpendicular to a movement direction of the image supporting member, which is larger than that of a pressing portion provided by said pressing member by an amount which is larger than the lateral shift.

32. An apparatus according to claim 31, wherein said pressing member is a pressing rotatable member having elasticity.

33. An apparatus according to claim 31, wherein said pressing portion is larger than the heat generating portion of said heater in a direction perpendicular to the movement direction of the image supporting member.

34. An apparatus according to claim 31, wherein said heater is stationary during its image fixing operation, and said film slides on said heater.

35. An apparatus according to claim 31, wherein said heater includes a linear heat generating layer extending in a direction crossing with the movement direction of the image supporting member, and said heat generating portion corresponds to the heat generating layer.

36. An apparatus according to claim 31, wherein said heat generating portion is longer, in a direction crossing with a conveyance direction of the image supporting member, than a width of a maximum usable size of said image supporting member.

37. An apparatus according to claim 31, wherein said control means includes detecting means for detecting a position of said endless film, and displaces a rotatable member rotating together with said endless film in accordance with detection signal from said detecting means to control the position of said endless film.

38. An apparatus according to claim 37, further comprising a driving roller for driving said endless film and a follower roller rotating following said endless film, and the displaceable rotatable member is the follower roller.

39. An apparatus according to claim 31, wherein said heater has a surface protection layer having a length, measured in a direction perpendicular to the movement direction of the image supporting member, which covers the moving range of said endless film.

40. An apparatus according to claim 39, wherein said protection layer is of glass.

* * * * *

UNITED STATES PATENT AND TRADEMARK OFFICE

CERTIFICATE OF CORRECTION

PATENT NO. : 5,171,145

DATED : December 15, 1992

INVENTOR(S) : KUSAKA ET AL.

It is certified that error appears in the above-identified patent and that said Letters Patent is hereby corrected as shown below:

TITLE PAGE

AT [30] FOREIGN APPLICATION PRIORITY DATA

"Nov. 11, 1988 [JP] Japan....53-285543" should read --Nov. 11, 1988 [JP] Japan....63-285543--.

COLUMN 1

Line 61, "portion 47," should read --portion 28,--.

COLUMN 2

Line 3, "member" should read --member 22--.
Line 22, "an" should read --a--.
Line 28, "an" should read --a--.

COLUMN 4

Line 43, "detec-" should read --direction--.
Line 44, "tion" should be deleted--.

UNITED STATES PATENT AND TRADEMARK OFFICE

CERTIFICATE OF CORRECTION

PATENT NO. : 5,171,145

DATED : December 15, 1992

INVENTOR(S) : KUSAKA ET AL.

It is certified that error appears in the above-identified patent and that said Letters Patent is hereby corrected as shown below:

COLUMN 6

Line 33, "decrease" should read --decreases--.

COLUMN 9

Line 2, "the" (second occurrence) should be deleted.
Line 4, "contain" should read --contains--.

COLUMN 10

Line 7, "operations" should read --operation--.

COLUMN 11

Line 42, "relationships" should read --relationship--.

COLUMN 12

Line 17, "thermister" should read --thermistor--.
Line 37, "what" should read --What--.

UNITED STATES PATENT AND TRADEMARK OFFICE

CERTIFICATE OF CORRECTION

PATENT NO. : 5,171,145

DATED : December 15, 1992

INVENTOR(S) : KUSAKA ET AL.

It is certified that error appears in the above-identified patent and that said Letters Patent is hereby corrected as shown below:

COLUMN 13

Line 43, "cording," should read --cording material,--

Signed and Sealed this

Fourth Day of January, 1994

Bruce Lehman

BRUCE LEHMAN

*Commissioner of Patents and Trademarks*

*Attest:*

*Attesting Officer*